US005277641A

United States Patent [19]

Gable et al.

[11] Patent Number: 5,277,641

[45] Date of Patent: Jan. 11, 1994

[54] SPINNING FLYING TOY WITH FLUID RELEASE

[76] Inventors: Derek J. Gable, 7246 Avenida Alisima, Rancho Palos Verdes, Calif. 90274; Rick Pennington, 435 Pebble Beach Way, Eagle, Id. 83616

[21] Appl. No.: 997,541

[22] Filed: Dec. 28, 1992

[51] Int. Cl.[5] ..... A63H 27/00; A63H 33/30; A63B 37/00; B05B 1/00

[52] U.S. Cl. ..... 446/46; 446/48; 446/475; 273/58 H; 273/349; 239/211; 239/289

[58] Field of Search ..... 219/211, 289, 214; 446/34, 46, 47, 48, 267, 475, 483; 273/58

[56] References Cited

U.S. PATENT DOCUMENTS

| | | | |
|---|---|---|---|
| 3,745,693 | 7/1973 | La Fata et al. | 446/15 |
| 3,959,916 | 6/1976 | Meyer | 446/47 |
| 4,157,632 | 6/1979 | Everett | 446/46 X |
| 4,184,284 | 1/1980 | Rogahn | 446/48 X |
| 4,212,460 | 7/1980 | Kraft | 273/58 H X |
| 4,274,591 | 6/1981 | Sunshine et al. | 239/2.11 X |
| 4,637,616 | 1/1987 | Whiting | 273/418 |

FOREIGN PATENT DOCUMENTS

| | | | |
|---|---|---|---|
| 819559 | 3/1937 | France | 273/425 |

*Primary Examiner*—D. N. Muir
*Attorney, Agent, or Firm*—Allan A. Dicke, Jr.

[57] ABSTRACT

Spinning toy carries a reservoir thereon with radially outward positioned discharge openings. When the reservoir is spun, water is discharged due to centrifugal forces resulting from the rotation of the spinning toy. A preferred embodiment is an aerodynamic disc.

11 Claims, 4 Drawing Sheets

SPINNING FLYING TOY WITH FLUID RELEASE

FIELD OF THE INVENTION

This invention is directed to spinning toys, and particularly aerodynamic spinning toys wherein the toy carries a reservoir and centrifugally discharged water.

BACKGROUND OF THE INVENTION

Many spinning toys are known, from hula hoops to aerodynamic discs. The spinning of such toys is essential to their operation because it provides dynamic stability. This invention is directed to the concept of employing that spinning to achieve the secondary benefit of discharging water out of an onboard reservoir by way of the pressure generated by spinning through one or more radially outward positioned discharge nozzles.

SUMMARY OF THE INVENTION

In order to aid in the understanding of this invention, it can be stated in essentially summary form that it is directed to a spinning toy with water discharge wherein the spinning toy carries a water reservoir thereon and the water reservoir has an outlet opening positioned radially outward from the spinning axis so that, when the toy is spinning, water is discharged from the opening. A preferred embodiment is an aerodynamic disc.

It is, thus, an object and advantage of this invention to provide a spinning toy with water discharge wherein the spinning toy spins about an axis. A reservoir carried on the spinning toy has a discharge opening positioned radially outward from the axis so water in the reservoir is discharged upon spinning of the toy.

It is a further object and advantage of this invention to provide a spinning toy with water discharge which enhances the play value of the spinning toy.

It is another object and advantage of this invention to provide a spinning toy with water discharge which is economic of manufacture and which is easily used so that the spinning toy can be widely enjoyed.

Other objects and advantages of this invention will become apparent from a study of the following portion of the specification, the claims and the attached drawings.

DESCRIPTION OF THE PREFERRED EMBODIMENT

Figure 1:
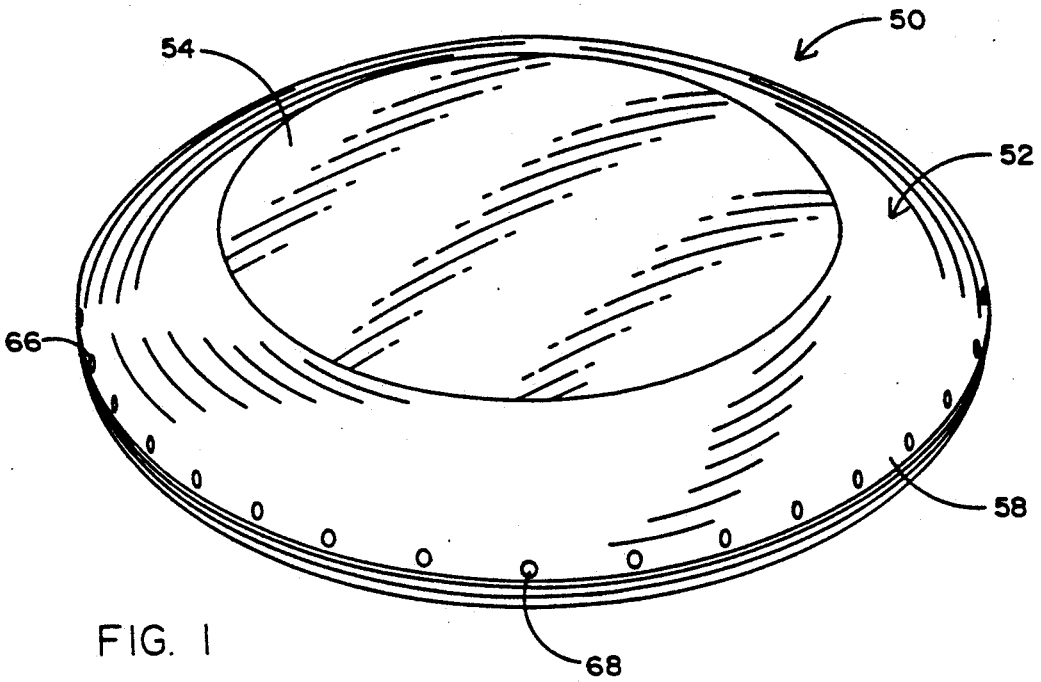
FIG. 1 is a perspective view of the first preferred embodiment of the spinning toy with water discharge in accordance with this invention.
Figure 2:
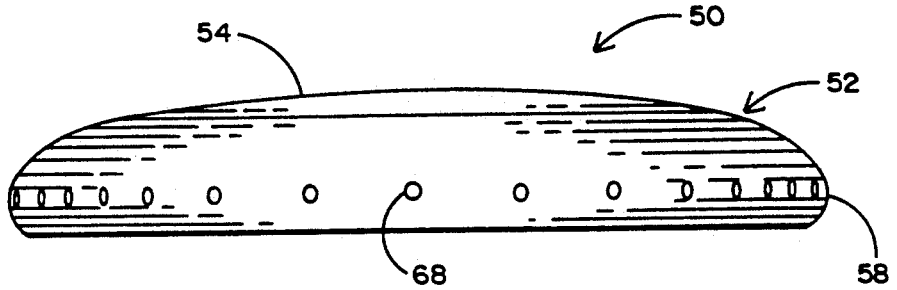
FIG. 2 is a side-elevational view thereof.
Figure 3:
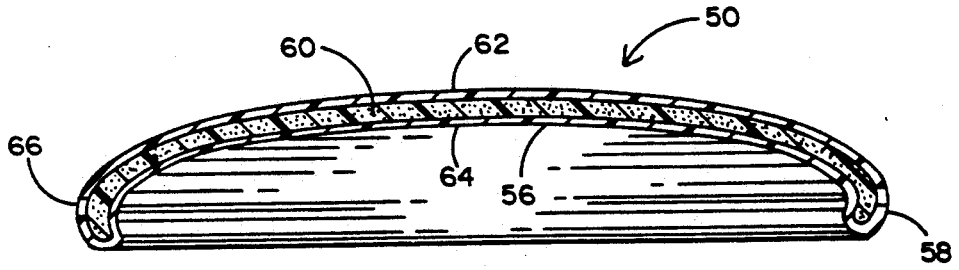
FIG. 3 is a transverse section through the spinning toy on its spinning axis.

FIGS. 1, 2 and 3 illustrate a first preferred embodiment of the spinning toy with water discharge of this invention where it is generally indicated at 50. The spinning toy has a body 52 which is disc-shaped with a convex top 54, concave bottom or under surface 56 and a down-turned rim 58. The body 52 is configured in the form of a well-known aerodynamic spinning toy. The structural difference of the body 52 is that it is molded of open, self-substantially rigid synthetic polymer composition material. This open self-foam material is positioned interiorly of the body and is generally indicated at 60 in FIG. 3. It comprises a foam layer throughout the dome-shaped body and down into the rim thereof. Upper and lower skins 62 and 64 are naturally formed on the film during the molding process and form the convex top and concave bottom surfaces.

The foam layer 60 serves as a reservoir. To permit water to flow into and out of the reservoir, at least one outlet opening is provided on the rim 58. Outlet openings 66 are specifically indicated in FIG. 1, outlet opening 68 is specifically indicated in FIG. 2, and outlet opening 66 is specifically identified in FIG. 3. As is seen in FIGS. 1 and 2, there is a series of outlet openings around the outer periphery at the downturned rim. The downturned rim forms a wall which is radially outward from the spinning axis. The spinning axis is the geometric center of the toy 50. When there is water in the reservoir formed by the foam layer and the toy 50 is launched, the spinning induced by the launch causes the water in the reservoir to be moved to the outlet openings by the pressure caused by the centrifugal force resulting from spinning. Water is thus discharged from the outlet openings to spray those along the flight path. The reservoir can be recharged by submerging the body 52 in water, preferably edgewise, so that air can bubble out while the water enters most of the openings. If desired, a separate inlet could be provided. This would mean removing the skin from the body, either the upper skin or lower skin on the axis so that water entry could be faster, but the water would move radially outward due to centrifugal force to move toward the outlet openings rather than be discharged from the axially located central filling opening. The outlet openings 66 and 68 and their companion openings may be punched into the rim 58, preferably in a radial direction. Another way to provide these openings is to remove the entire outer skin in sections around the rim or completely around the rim. In this way, the open self-foam core would be exposed in certain limited areas, and the foam openings themselves would serve as the outlet openings.

Figure 4:
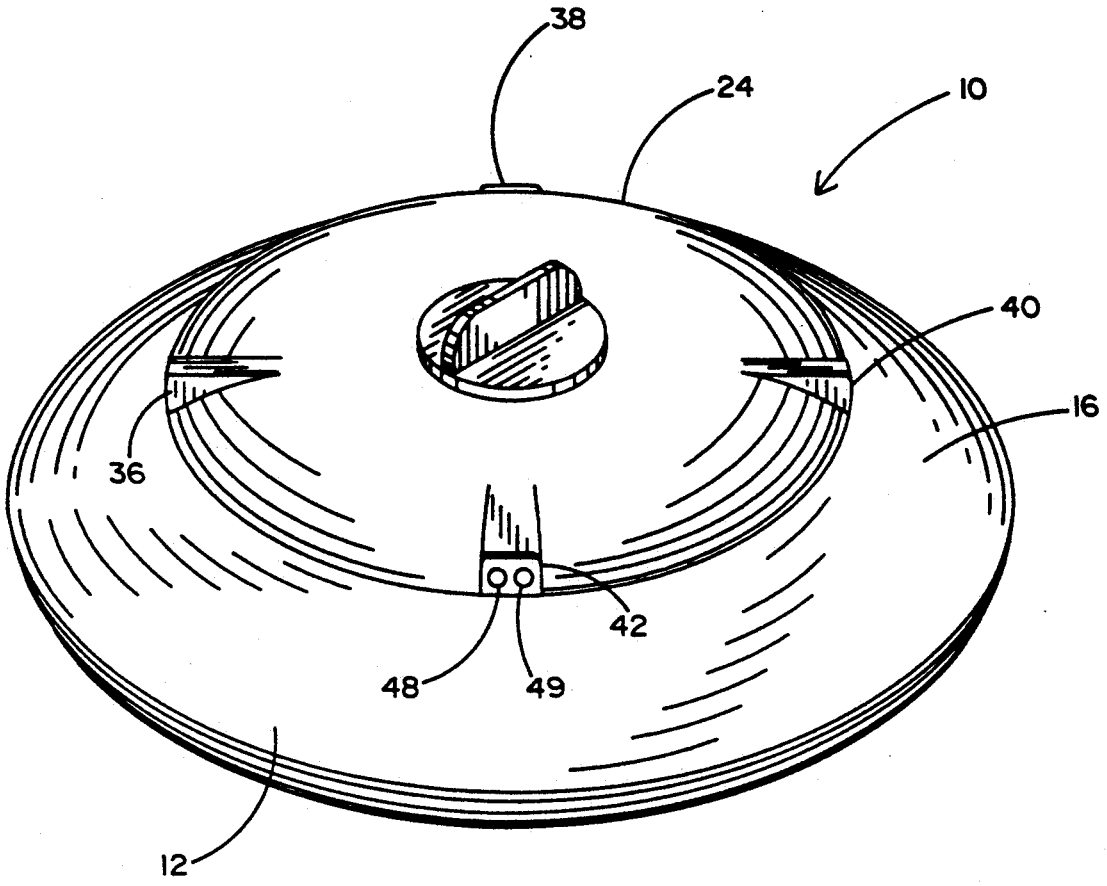
FIG. 4 is an isometric view of the second preferred embodiment of the spinning toy with water discharge of this invention.
Figure 5:
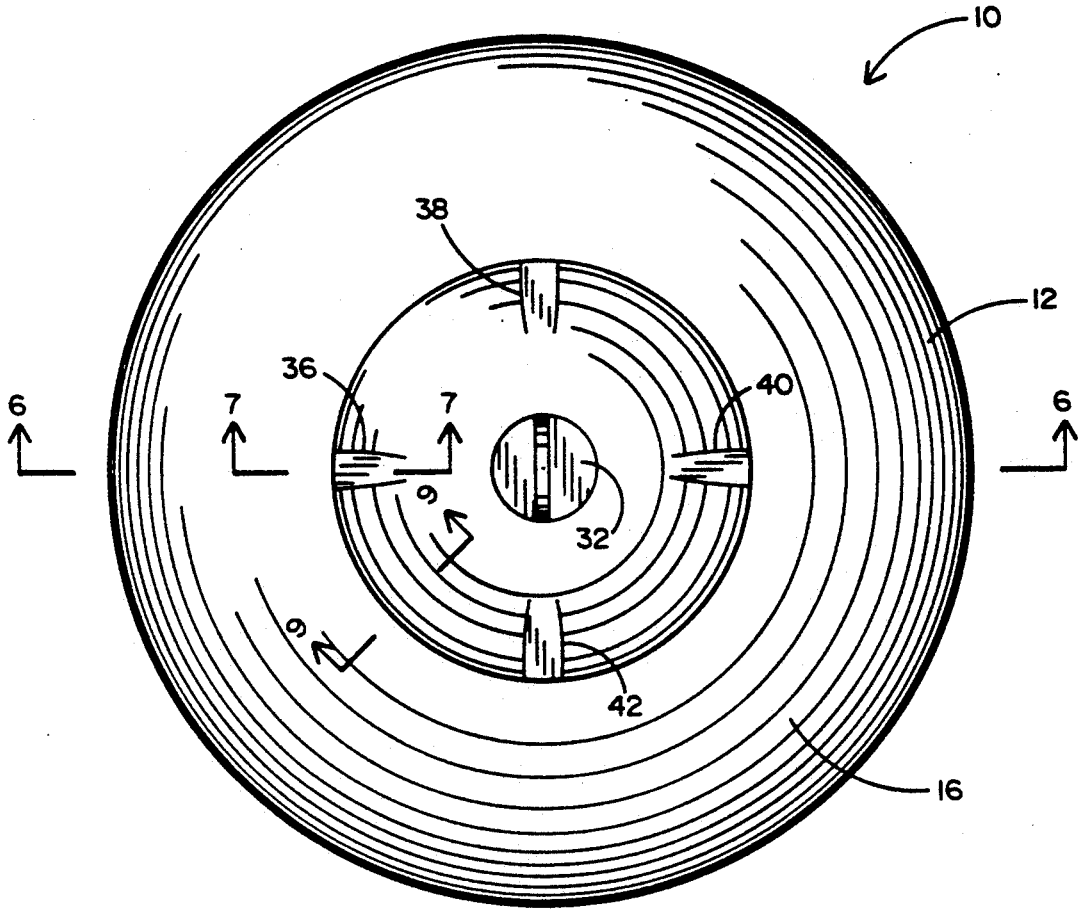
FIG. 5 is a plan view thereof.
Figure 6:
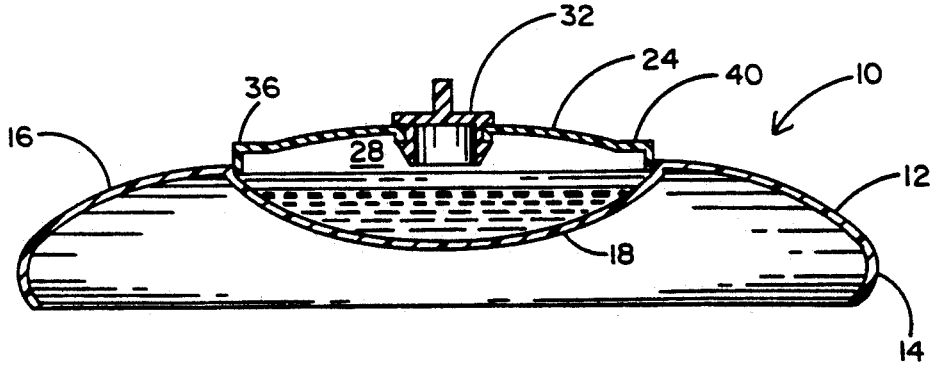
FIG. 6 is a section taken generally along line 6—6 of FIG. 5.
Figure 10:
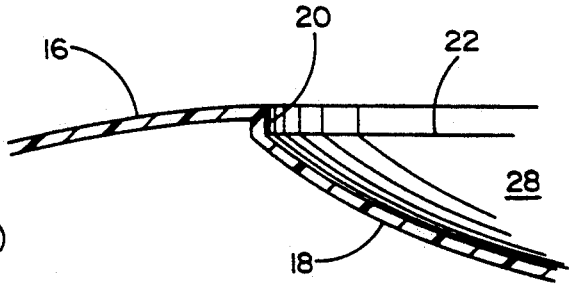
FIG. 10 is a view similar to FIG. 9, showing the toy body before the reservoir cover is attached.

FIGS. 4, 5 and 6 illustrate a second preferred embodiment of the spinning toy with water discharge of this invention where it is generally indicated at 10. The toy 10 may be any type of spinning toy and, in the preferred embodiment shown, it is an aerodynamic disc. However, other types of spinning toys can incorporate the water reservoir and discharge nozzles, in accordance with this invention. The toy has a body 12 which is circular, as seen in plan view in FIG. 5. The body has an axis which is perpendicular to the sheet in FIG. 5 at the center of the circular body. As seen in FIG. 6, the circular body has a downwardly directed lip 14 which is part of the aerodynamic design. The body is of thin wall construction, as seen in FIG. 6, and may be molded of thermoplastic synthetic polymer composition material. The dome 16 of the body is upwardly convex. Toward the center, the body has a downwardly curved lower reservoir wall 18. As seen in FIG. 10, the dome 16 and lower reservoir wall 18 are contiguously formed and preferably have a cylindrical wall 20 therebetween. The cylindrical wall is concentric about the axis and terminates in a shoulder 22.

Figure 8:
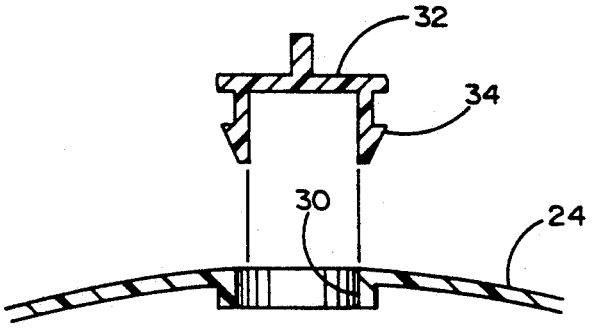
FIG. 8 is an enlarged section, with parts broken away, through the filling port of the reservoir, showing the filling plug in exploded position.
Figure 9:
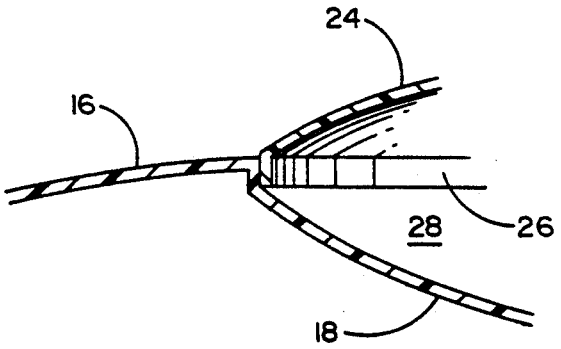
FIG. 9 is an enlarged section taken generally along line 9—9 of FIG. 5.

Reservoir cover 24 is a circular domed structured, generally a surface of revolution around the same axis. It has a downwardly extending lip 26, see FIG. 9, which engages inside the cylindrical wall 20 and against the shoulder 22 to substantially enclose the reservoir space 28. On the axis, reservoir cover 24 has an inlet opening 30, see FIG. 8. Cap 32 can engage in the opening to substantially close the opening, as shown in FIGS. 4, 2 and 3. The cap 32 can be removed, as shown in FIG. 8, to permit the pouring of water into the reservoir space. Ears 34 on the cap resiliently engage below the inlet opening to releasably retain the cap in place. The reservoir cover is domed to define a compatible curvature with the dome of the body.

Figure 7:
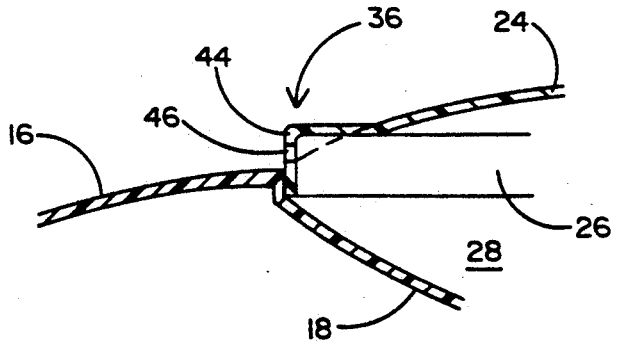
FIG. 7 is an enlarged section, with parts broken away, taken generally along line 7—7 of FIG. 5.

As thus far described, with the reservoir cover sealed into the body around lip 26, a reservoir without an outlet has been described. However, nozzle housings are formed on the reservoir cover. Nozzle housings 36, 38, 40 and 42 are formed upward from the dome of the reservoir cover so that they provide a nozzle wall which is above the dome 16. Nozzle wall 44 is illustrated for nozzle housing 36 and is seen in FIG. 7. The nozzle wall 44 is preferably in line with lip 26, as shown in FIG. 4. In any event, the nozzle wall 44 extends above dome 16 to permit outlet openings or nozzles therein. Outlet nozzle 46 is shown in nozzle wall 44 in FIG. 7. Outlet nozzles 48 and 49 are shown with respect to nozzle housing 42 in FIG. 1. Only one nozzle may be provided in each nozzle wall, or more than two may be provided if more droplets are desired. Furthermore, while four nozzle housings are illustrated, more may be employed, but it is thought that more than four nozzle housings and more than eight outlet nozzles are not required. The number and size of outlet nozzle openings is a function of the desired droplet size of how quickly the discharge of water is desired.

The toys 10 and 50 are toys which spin when they are played with. The spinning causes spinning of the water in the reservoir space, and the spinning of the water causes centrifugal force at the nozzle openings since the nozzle openings are radially outward from the axis of spinning. Water pressure builds up within the reservoir space at the outlet nozzle as a function of rotational speed and radius. When the toys 10 and 50 have water in their reservoir spaces and are played with in the normal manner, the spinning of the toys causes discharge of the water from the outlet nozzles. This adds an additional pleasure factor in playing with the spinning toys. When the spinning toys are aerodynamic discs, as indicated in the preferred embodiment, the discs are designed so that they fly a substantially straight and level flight when properly thrown. The water discharge is thus delivered substantially horizontally along its flight path, giving water droplet sensations to the persons along its path.

This invention has been described in its presently contemplated best embodiment, and it is clear that it is susceptible to numerous modifications, modes and embodiments within the ability of those skilled in the art and without the exercise of the inventive faculty. Accordingly, the scope of this invention is defined by the scope of the following claims.

What is claimed is:

1. A spinning toy comprising:

a body, said body having an axis, said body being symmetric about said axis, said body being configured to spin about said axis, said body being configured as an aerodynamic toy for free flight, said body being molded of open cell foam having an upper skin layer and lower skin layer and having a rim to form a reservoir in said body configured for the containment of liquid, said reservoir being symmetric about said axis so that said foam layer acts as said reservoir; and openings in said rim into said foam layer, said openings acting as outlet nozzles, said outlet nozzles being positioned radially outward from said axis so that as said spinning toy is spun, liquid in said reservoir is centrifugally discharged from said outlet nozzles.

2. The spinning toy of claim 1 wherein said rim is a downturned rim and said upper skin layer is continuous around said rim, said openings being through said skin layer on said rim.

3. The spinning toy of claim 2 wherein there is a plurality of outlet nozzles and said outlet nozzles are outwardly directed and are substantially equi-angularly spaced around said axis.

4. A spinning toy comprising:

a body having an axis of rotation and being configured for aerodynamic flight while spinning about said axis, said body having a dome, said body having a lower reservoir wall radially inward from said dome and depressed below said dome;

an upper reservoir cover wall positioned over said lower reservoir wall to define a reservoir space therebetween, said reservoir cover wall comprising said dome over said reservoir space;

at least one outlet nozzle in one of said reservoir walls, said outlet nozzle being positioned radially outward from said axis so that upon the placement of liquid in said reservoir and spinning flight of said body, liquid is discharged from said outlet nozzle.

5. The spinning toy of claim 4 wherein said reservoir cover wall is permanently attached to said body and there is a filler opening and filler cap into said reservoir space for the filling thereof.

6. The spinning toy of claim 4 wherein said outlet nozzle is positioned in a nozzle wall on said reservoir cover which is substantially parallel to said axis.

7. The spinning toy of claim 6 wherein there is a plurality of outlet nozzles and said outlet nozzles are angularly spaced around said axis.

8. The spinning toy of claim 7 wherein said outlet nozzles are substantially equi-angularly spaced around said axis.

9. The spinning toy of claim 6 wherein said plurality of outlet nozzles lie in a plane which is substantially perpendicular to said axis.

10. The spinning toy of claim 5 wherein said reservoir cover is permanently attached to said body and there is a filler opening and filler cap into said reservoir space for the filling thereof.

11. The spinning toy of claim 10 wherein said filler opening is in said reservoir cover.

* * * * *